US005730621A

United States Patent [19]

Wang

[11] Patent Number: 5,730,621

[45] Date of Patent: Mar. 24, 1998

[54] DUAL-JACK ELECTRICAL CONNECTOR

[75] Inventor: Tsan-Chi Wang, Hsin-Tien, Taiwan

[73] Assignee: Insert Enterprise Co., Ltd., Hsin-Tien, Taiwan

[21] Appl. No.: 630,142

[22] Filed: Apr. 10, 1996

[51] Int. Cl.[6] ..... H01R 9/09

[52] U.S. Cl. ..... 439/541.5; 439/620; 439/63

[58] Field of Search ..... 439/541.5, 63, 439/620, 675, 608

[56] References Cited

U.S. PATENT DOCUMENTS 5,613,880 3/1997 Wang ..... 439/541.5

FOREIGN PATENT DOCUMENTS 210186 5/1982 Taiwan .
222831 5/1982 Taiwan .

*Primary Examiner*—Gary F. Paumen
*Attorney, Agent, or Firm*—Fish & Richardson P.C.

[57] ABSTRACT

A dual-jack electrical connector including a casing, and two jacks, each of the jacks comprising a tubular metal shell, an insulative tube axially mounted within the tubular metal shell, and a signal terminal axially mounted inside the insulative tube, wherein the casing defines two axial holes disposed in a parallel relation; the jacks are respectively mounted in the axial holes of the casing.

12 Claims, 4 Drawing Sheets

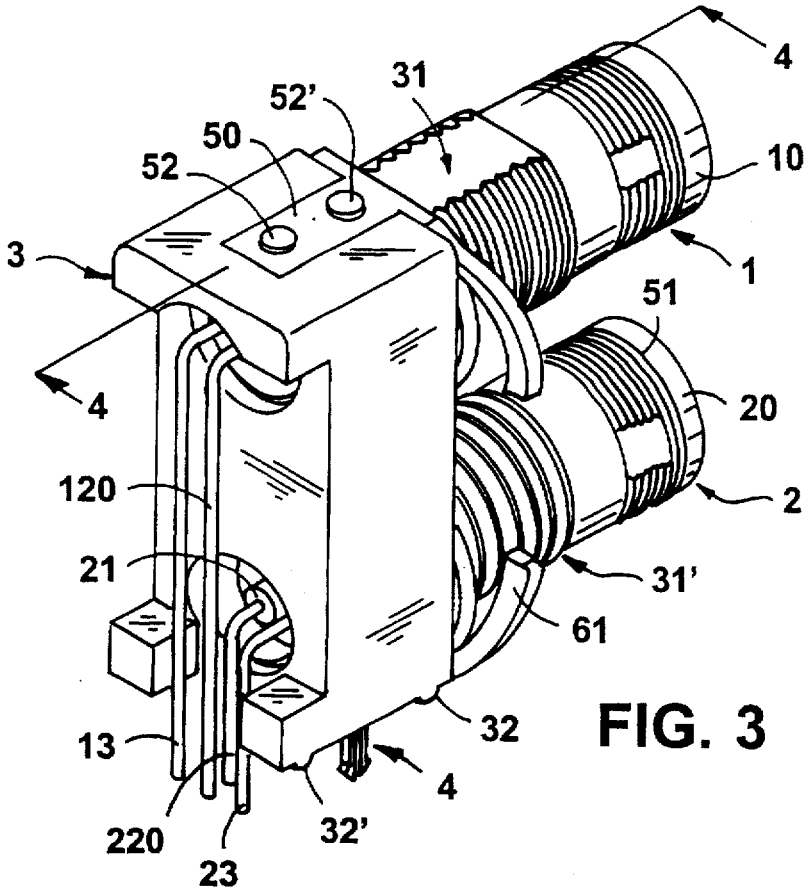
FIG. 3
FIG. 4
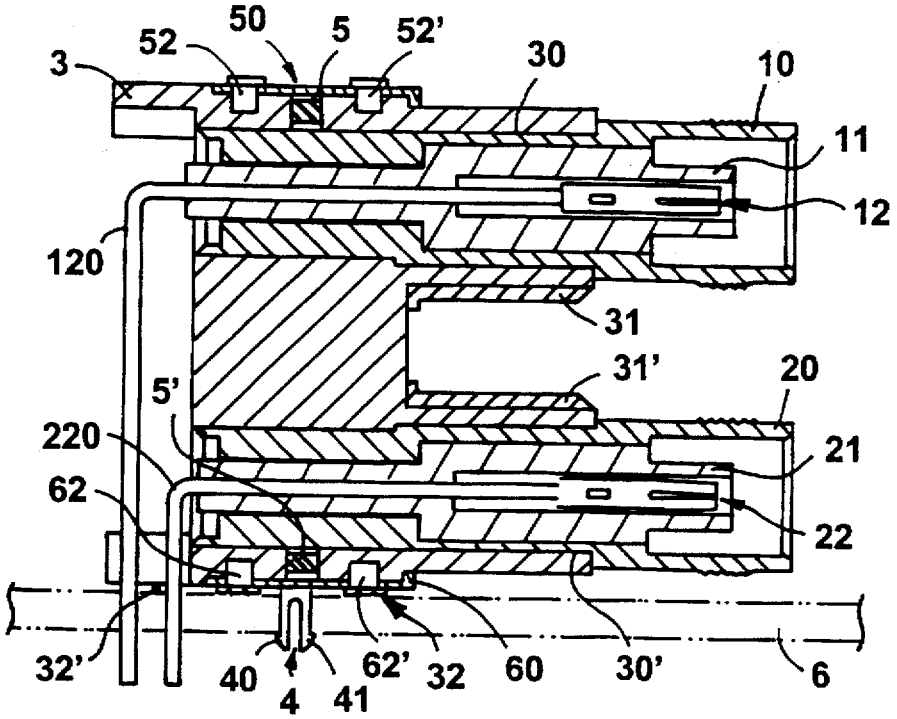

DUAL-JACK ELECTRICAL CONNECTOR

BACKGROUND OF THE INVENTION

The present invention relates to electrical connectors, and relates more particularly to a dual-jack electrical connector for mounting on a circuit board.

A variety of connectors for installation in a PC board to connect a coaxial cable have been developed. Exemplars are seen in U.S. Pat. No. 4,659,156 entitled "COAXIAL CONNECTOR WITH CIRCUIT BOARD MOUNTING FEATURES; Chinese Pat. No. 210,186 entitled "IMPROVED STRUCTURE OF BNC CONNECTOR FOR COMPUTERS"; Chinese Pat. No. 222,831 entitled "CLAMPING TYPE BNC CONNECTOR ASSEMBLY". These electrical connectors have only one BNC jack for the connection of one plug from a network cable to a PC board. When connect two plug from a network cable to a PC board for example the master board of a notebook computer, two BNC (Bayonet Neill Concelman, sometimes referred to as "Bayonet Navy Connector") jacks must be used. However, much PC board installation space is needed when the number of BNC connectors is increased.

SUMMARY OF THE INVENTION

The present invention has been accomplished to provide a dual-jack electrical connector which eliminates the aforesaid drawbacks.

It is one object of the present invention to provide an electrical connector which has two jacks for the connection of two plugs from a network cable to a PC board. It is another object of the present invention to provide a dual-jack electrical connector which has respective a filter means, a respective signal terminal, and a respective ground terminal at each of the two jacks thereof to fit different grounding conditions.

According to one aspect of the present invention, the dual-jack electrical connector comprises a casing, and two jacks, each of the jacks comprising a tubular metal shell, an insulative tube axially mounted within the tubular metal shell, and a signal terminal axially mounted inside the insulative tube, wherein the casing defines two axial holes disposed in a parallel relation; the jacks are respectively mounted in the axial holes of the casing. According to another aspect of the present invention, the casing has mounting rods for fastening to a circuit board for permitting the jacks to be connected to respective electrical connectors from a network cable, and the mounting rods can be disposed in parallel to the axial holes of the casing so that the jacks can be disposed in vertical when the casing is fastened to the circuit board. Alternatively, the mounting rods can be disposed perpendicular to the axial holes of the casing so that the jacks can be axially disposed in parallel to the circuit board after the installation of the casing. According to still another aspect of the present invention, the casing can be injection-molded from plastic, or made from metal.

BRIEF DESCRIPTION OF THE DRAWINGS

FIG. 3 is an elevational view of a dual-jack electrical connector according to the present invention;

FIG. 4 is a sectional view taken along line 4—4 of FIG. 3;

DETAILED DESCRIPTION OF THE PREFERRED EMBODIMENT

Figure 2:
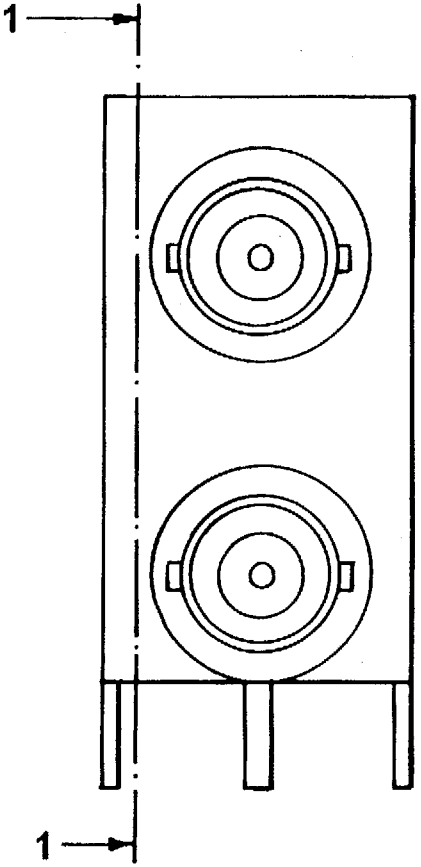
FIG. 2 PRIOR ART
FIG. 2 is a cross sectional view of the two BNC jacks shown in FIG. 1.
Figure 1:
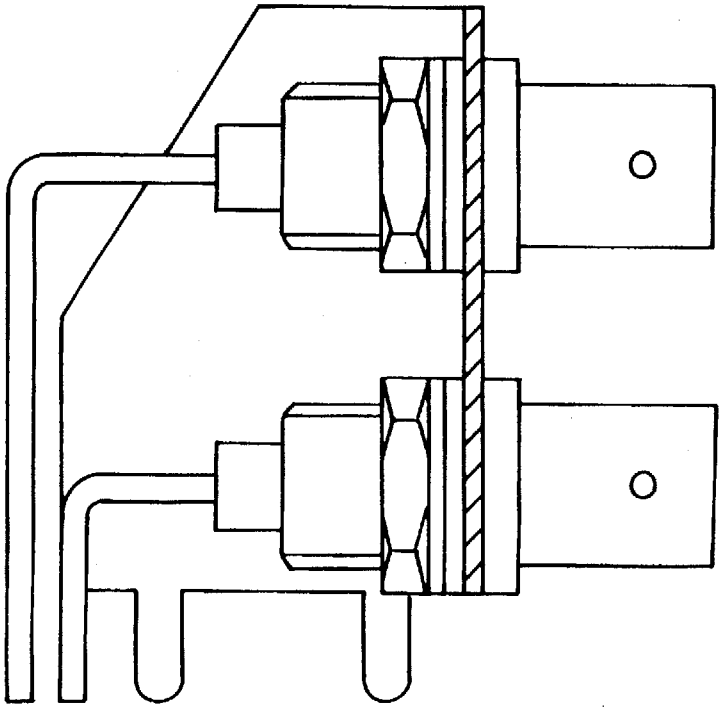
FIG. 1 PRIOR ART
FIG. 1 is a front view of two BNC jacks combined together according to the prior art.

Referring to FIGS. 3 and 4, an electrical connector in accordance with the present invention is generally comprised of a first TNC (Threaded Neill Concelman, sometimes referred to as "Threaded Navy Connector") jack 1, a second TNC jack 2, a casing 3, which holds the first TNC jack 1 and the second TNC jack 2 in parallel, two filter means respectively mounted in the casing 3 to filter noises, and a plurality of split mounting rods 4 for fastening the casing 3 to a circuit board 6.

Referring to FIGS. 3 and 4 again, the TNC jacks 1, 2 are identical and respectively fastened to the casing 3. Each of the TNC jacks 1, 2 comprises a tubular metal shell 10 or 20, an insulative tube 11 or 21 axially mounted within the tubular metal shell 10 or 20, a signal terminal 12 or 22 axially mounted inside the insulative tube 11 or 21 and having a tail 120 or 220 connected to the circuit board 6, and a ground terminal 13 or 23 extending from the tubular metal shell 10 or 20 for connection to ground to form with the tubular metal shell 10 or 20 an earth loop. The casing 3 is injection-molded from insulative material (plastics) having two parallel axial holes 30 and 30' for mounting the first TNC jack 1 and the second TNC jack 2, and two externally threaded coupling portions 31 and 31' respectively axially extending from the axial holes 30 and 30' at one side for mounting on an object. Each of the aforesaid filter means comprises a capacitor 5 or 5' mounted in a respective through hole (not shown) on the casing 3, and an electrical conductive plate 50 or 60 fastened to the casing 3 at one side by fastening elements 52, 52' or 62, 62' to hold down the capacitor 5 or 5', permitting both terminals of the capacitor 5 or 5' to be respectively connected between the tubular metal shell 10 or 20 of the TNC Jack 1 or 2 and the electrical conductive plate 50 or 60. The aforesaid split mounting rods 4 are fixedly secured to the bottom side of the casing 3, each split mounting rod 4 having two hooked portions 40 and 41. The casing 3 further comprises a plurality of raised portions 32 and 32' raised from the bottom side. When the casing 3 is installed in the circuit board 6, the raised portions 32 and 32' are stopped above the circuit board 6 to space the electrical conductive plate 60 from the circuit board 6, and therefore the electrical conductive plate 60 does not contact the circuit board 6.

Figure 5:
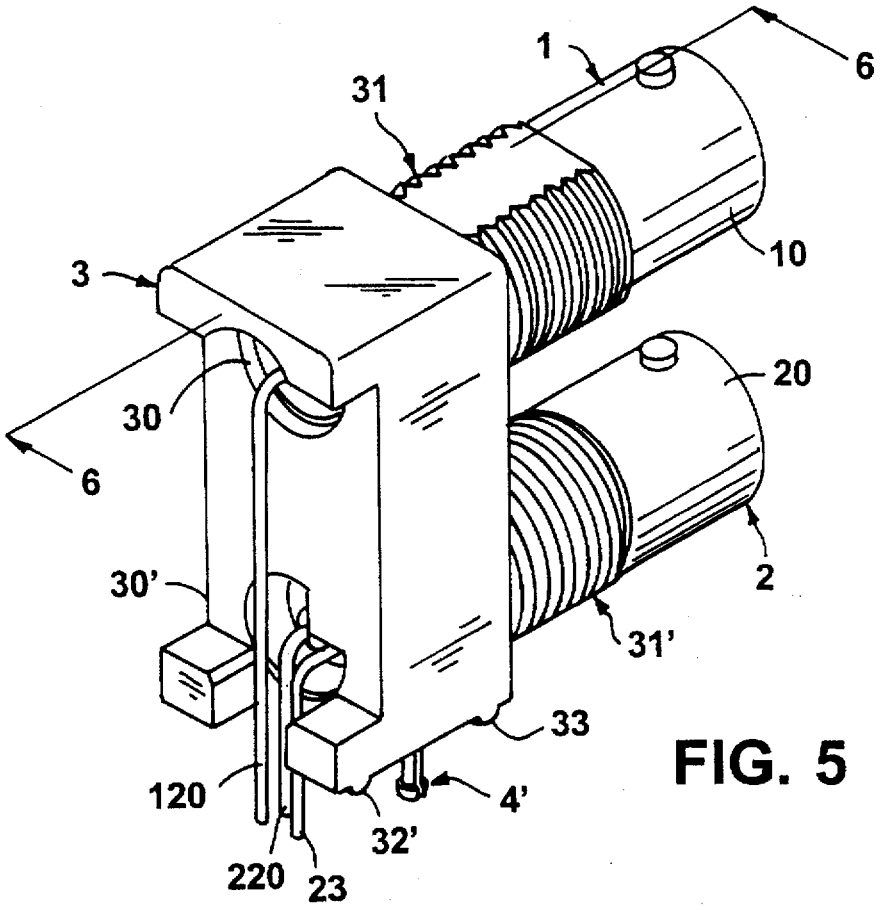
FIG. 5 is an elevational view of an alternate form of the dual-jack electrical connector according to the present invention.
Figure 6:
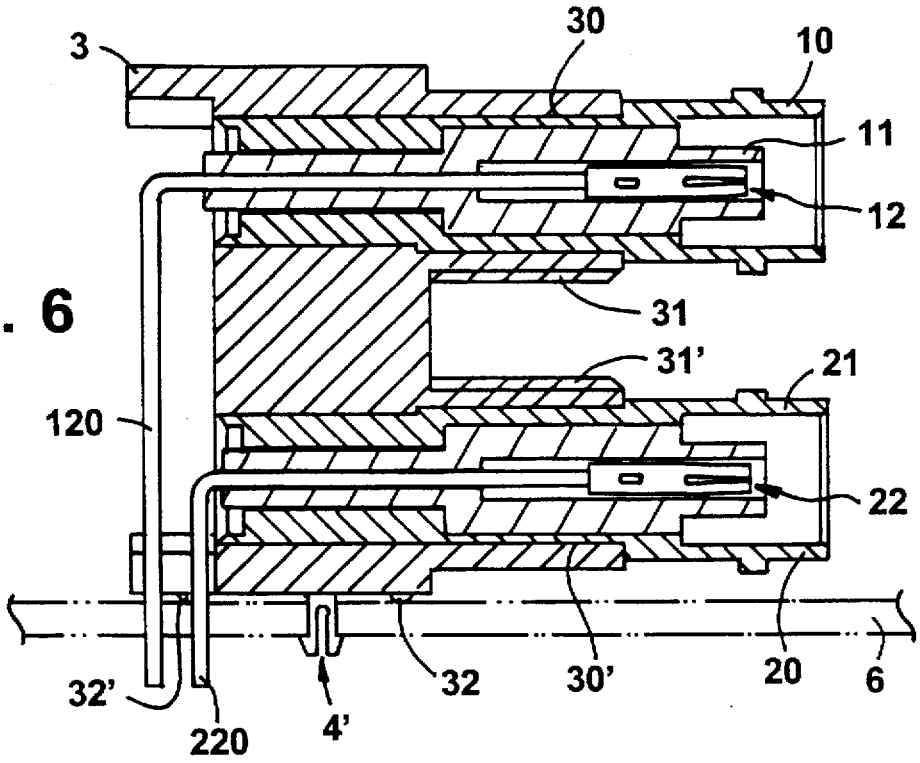
FIG. 6 is a sectional view taken along line 6—6 of FIG. 5.

FIGS. 5 and 6 show an alternate form of the present invention. According to this alternate form, the BNC jacks 1, 2 are identical and respectively fastened to the casing 3. The casing 3 is made from metal and the installation of the aforesaid filter means is eliminated.

Figure 7:
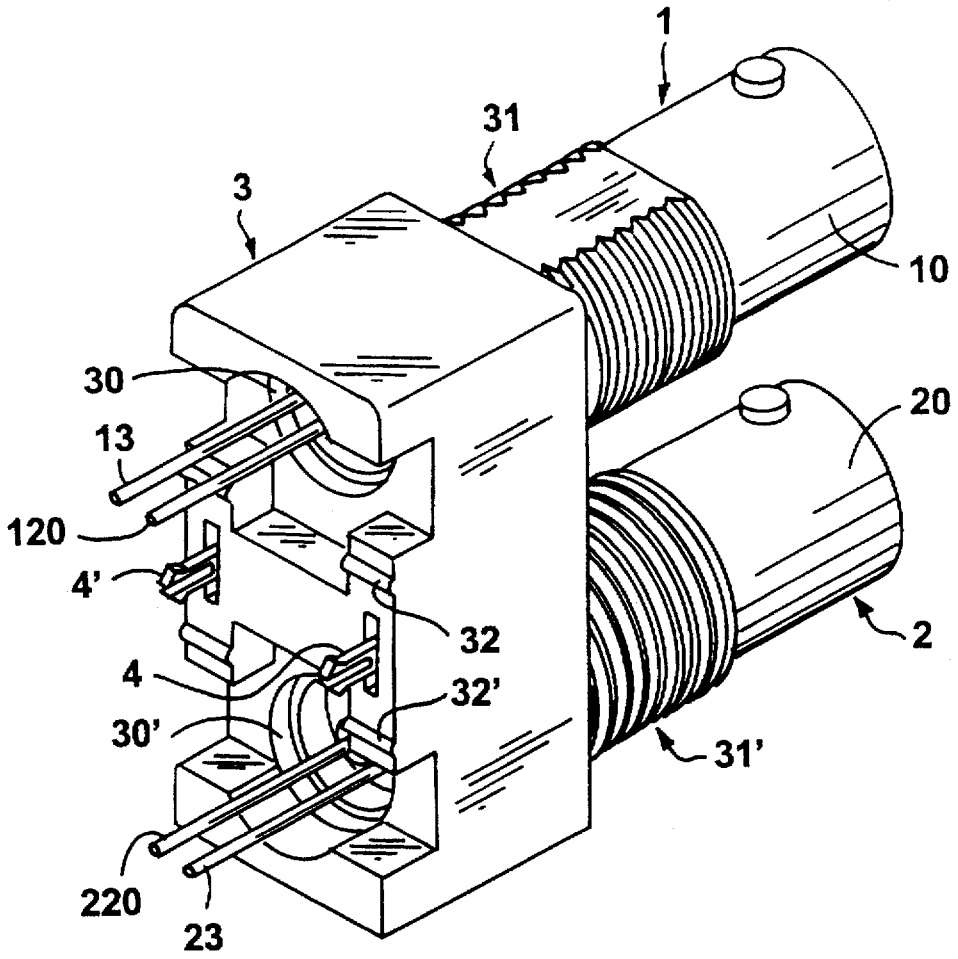
FIG. 7 is an elevational view of another alternate form of the dual-jack electrical connector according to the present invention.

FIG. 7 shows another alternate form of the present invention. According to this alternate form, the tails 120, 130 of the signal terminals and the ground terminals 13, 23 are made of straight shape and respectively axially extending from the BNC jacks 1 and 2; the split mounting rods 4 and 4' and the raised portions 32 and 32' are respectively raised from the back side of the casing 3 in the same direction of the ground terminals 13 and 23. This arrangement permits the electrical connector to be installed in a circuit board in vertical.

It is to be understood that the drawings are designed for purposes of illustration only, and are not intended as a definition of the limits and scope of the invention disclosed.

I claim:

1. The dual-jack electrical connector comprising a casing and two jacks, said jacks comprising substantially identical, straight tubular metal shells, substantially identical, straight insulative tubes axially mounted within said tubular metal shells, and signal terminals axially mounted inside said insulative tubes;

wherein said casing defines two substantially identical axial holes disposed in parallel relation; said jacks being respectively mounted in the axial holes of said casing;

and said casing comprises a plurality of mounting rods for fastening to a circuit board.

2. The dual-jack electrical connector of claim 1 wherein each of said tubular metal shells comprises a ground terminal.

3. The dual-jack electrical connector of claim 1 wherein said casing is injection-molded from plastic.

4. The dual-jack electrical connector of claim 1 wherein said casing comprises capacitor means disposed in contact with the tubular metal shell of each of said jacks.

5. The dual-jack electrical connector of claim 1 wherein each of said mounting rods has two hooked portions disposed in a parallel relation.

6. The dual-jack electrical connector of claim 1 wherein said mounting rods are disposed perpendicular to the axial holes of said casing so that said jacks are axially disposed in parallel to the circuit board after the installation of said casing in the circuit board.

7. The dual-jack electrical connector of claim 1 wherein said casing includes a filter attached thereto.

8. The dual-jack electrical connector of claim 7 wherein said filter includes an electrically conductive plate.

9. The dual-jack electrical connector of claim 8 wherein said connector is fastened to a circuit board.

10. The dual-jack electrical connector of claim 9 wherein said casing comprises a plurality of raised portions that space said electrical conductive plate from said circuit board.

11. The dual-jack electrical connector comprising a casing, and two jacks, said jacks comprising substantially identical, straight tubular metal shells, substantially identical, straight insulative tubes axially mounted within said tubular metal shells, and signal terminals axially mounted inside said insulative tubes;

wherein said casing is made from metal and defines two substantially identical axial holes disposed in parallel relation; said jacks being respectively mounted in the axial holes of said casing.

12. The dual-jack electrical connector comprising a casing and two jacks, said jacks comprising substantially identical, straight tubular metal shells, substantially identical, straight insulative tubes axially mounted within said tubular metal shells, and signal terminals axially mounted inside said insulative tubes;

wherein said casing defines two substantially identical axial holes disposed in parallel relation; said jacks being respectively mounted in the axial holes of said casing;

wherein said jacks are threaded navy connector jacks.

* * * * *